United States Patent [19]

Witzel

[11] 4,427,339

[45] Jan. 24, 1984

[54] RADIAL FANWHEELS

[75] Inventor: Karlheinz Witzel, Stuttgart, Fed. Rep. of Germany

[73] Assignee: Suddeutsche Kuhlerfabrik Julius Fr. Behr GmbH & Co. KG, Fed. Rep. of Germany

[21] Appl. No.: 333,977

[22] Filed: Dec. 23, 1981

[30] Foreign Application Priority Data

Dec. 31, 1980 [DE] Fed. Rep. of Germany ..... 3049596
May 14, 1981 [DE] Fed. Rep. of Germany ..... 3119096

[51] Int. Cl.[3] ..... F01D 5/00

[52] U.S. Cl. ..... 416/131; 416/135; 416/178

[58] Field of Search ..... 416/88, 132 A, 134 R, 416/135, 178, 196 R, 243, 187, 131 R, 131 A, 240; 415/141

[56] References Cited

U.S. PATENT DOCUMENTS

| | | | |
|---|---|---|---|
| 1,149,638 | 8/1915 | Davidson | 416/187 X |
| 1,378,561 | 5/1921 | Rowlett | 416/178 |
| 1,751,570 | 3/1930 | Allen | 416/196 R |
| 1,996,155 | 4/1935 | Janette | 416/187 |
| 2,237,451 | 4/1941 | Samuels | 416/187 |
| 2,652,190 | 9/1953 | Meltzer | 416/178 |
| 3,211,891 | 10/1965 | Kendall | 416/178 X |
| 3,635,588 | 1/1972 | Lester et al. | 416/187 |

FOREIGN PATENT DOCUMENTS

| | | | |
|---|---|---|---|
| 2606817 | 9/1977 | Fed. Rep. of Germany | 416/178 |
| 2621199 | 11/1977 | Fed. Rep. of Germany | 416/178 |
| 1421795 | 1/1976 | United Kingdom | 416/187 |

*Primary Examiner*—Philip R. Coe
*Assistant Examiner*—Frankie L. Stinson
*Attorney, Agent, or Firm*—Craig & Burns

[57] ABSTRACT

The invention relates to a radial fanwheel, wherein the fan blades are connected to a hub by spokes. Each fan blade is connected by connecting elements to the adjacent fan blades in the vicinity of their ends. Specifically, the spokes and connecting elements, as well as the fan blades themselves, are elastically deformable by the loads which develop.

12 Claims, 6 Drawing Figures

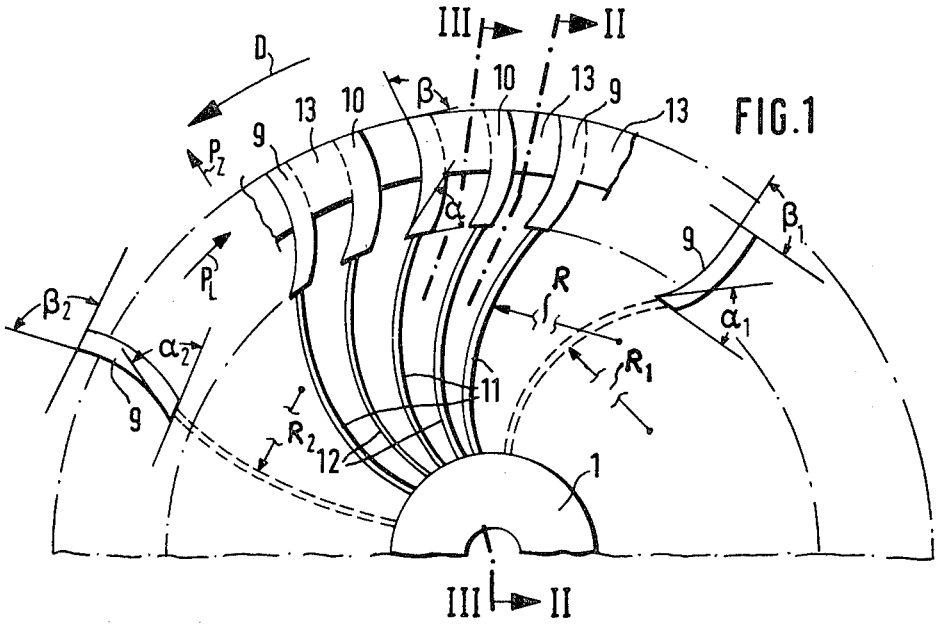
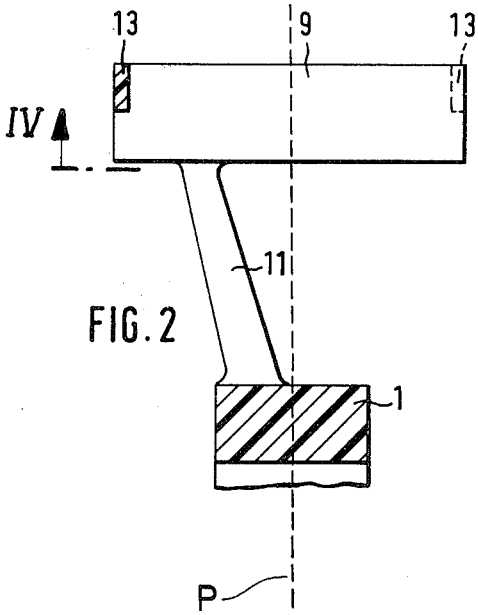
FIG.2
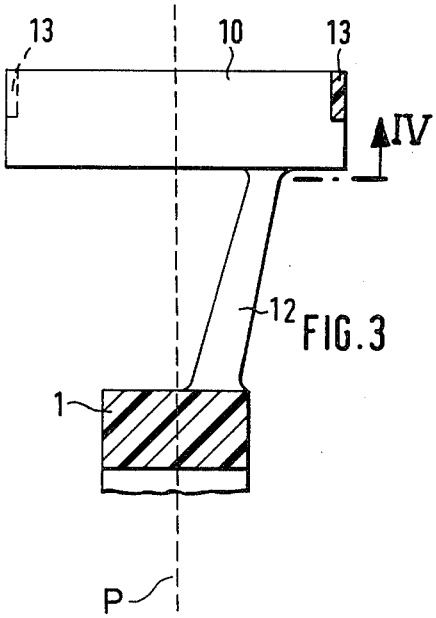
FIG.3

RADIAL FANWHEELS

BACKGROUND AND SUMMARY OF THE INVENTION

The invention relates to a radial fanwheel with a hub and a plurality of fan blades, the blades being in an array that is disposed concentrically with respect to the hub and forwardly bowed (i.e., curved as if bent forwardly at its ends so as to form a forwardly open concave surface), the blades being linked to the hub by spokes.

Radial fanwheels of the type described above, also known as drum fanwheels, are used for single-flow blowers, i.e., blowers with a unilateral intake; or for double-flow blowers, i.e., blowers with a bilateral intake. It is known that the fan blades can be mounted to the hub by means of a disk, whereby the tips of the fan blades are held by rings or cover disks. When the disk, which serves as a connecting part, is connected with one of the two cover disks, the fanwheel is limited to a single-flow blower design. It is also possible to attach the connecting disk to the fan blades between the two covered disks, producing a radial fanwheel suitable for a double-flow blower. The arrangement of the disk determines the flow distribution, i.e., the air volume to be drawn in from one side or the other. If a different distribution is desired, another radial fanwheel with a suitably different arrangement of the connecting disk must be manufactured.

Radial fanwheels of this type are also oriented rotational-directionwise. Their asymmetrical design makes it impossible to convert them to a different rotational direction simply by turning them through 180°. Instead, different radial fanwheels must be manufactured for clockwise rotation and for counterclockwise rotation. These measures result in a considerable manufacturing cost increase and in costly stock maintenance.

It has also been proposed (German Patent Application No. P 29 39 385.9-15) to provide the connecting disk with apertures, so that, in effect, the fan blades are linked to the hub by spokes. This design has the advantage of producing a radial fanwheel which can be used as both a single-flow blower and a double-flow blower, since the air volumes drawn in are automatically distributed through the openings. In this design also, however, at least two different radial fanwheels must be manufactured to permit one arrangement with clockwise rotation and another arrangement with counterclockwise rotation, resulting in high manufacturing costs.

Thus, a principal object of the present invention is to achieve a radial fanwheel of the type described above that can be used either for a single-flow or a double-flow blower, with clockwise or counterclockwise rotation, independently of the intake direction. This object is attained in a preferred embodiment by virtue of the fact that backwardly-curved spokes are staggered with respect to one another and arranged successively around the circumference relative to the radial center plane, each of said spokes holding a fan blade in the vicinity of one of its ends in such a manner that each fan blade is connected at one end with the fan blade ahead of it in the circumferential direction and at the other end with the fan blade behind it.

This design makes it possible to devise a radial fanwheel whose structure is symmetrical with respect to the radial center plane, so that it can be used for either clockwise or counterclockwise rotation by simply turning it through 180°. It is also possible to use this radial fanwheel in either single-flow or double-flow blowers, since the spokes do not significantly impede the air flow and thereby permit free air distribution. An endless meander-shaped structure composed of fan blades and running in the circumferential direction of the radial fanwheel is conceptually part of this invention. Furthermore, this structure is manufacturable as a plastic part by using an injection molding machine, especially since no rings or cover disks are provided for the fan blades. In this regard, it is noted that the curved shape of the blades is produced by the shape of the mold cavity so that, while the term "bowed" is used relative to blades produced in such a manner, it should be understood to mean only that they are in the shape of a simple curve and not that the blades are actually "bent" from a straight configuration.

In order to produce a radial fanwheel of this type while designing the invention so that it is capable of adjusting automatically to different load conditions and forces which develop, especially in conjunction with a drive motor which changes its rotational speed as a function of load, a provision is made for the spokes and fan blades and/or the connecting elements linking the fan blades to be so dimensioned that the radial length of the spokes can change by elastic modification of the curvature of the spokes, and the diameter of the blade ring formed by the fan blades can be modified by elastic twisting and/or bending of the fan blades and/or of the connectors, depending on the loads which develop.

A radial fanwheel in accordance with the present invention has, firstly, the advantage that balancing is no longer required, since any slight imbalance which might possibly be present as a result of the injection molding technique will cause the radial fanwheel to deform slightly elastically during operation to conform to this imbalance, so that it runs smoothly after this deformation has taken place. There is no feedback of the imbalance through the elastic spokes, so that no balancing measures need be taken. A fanwheel of this type also has the advantage that it adapts to a certain extent to load conditions as they change, and serves to offset them. For example, if the load increases, the aerodynamic forces acting circumferentially on the fan blades cause the spokes (which are curved oppositely relative to the forwardly bowed blades) to flex, thereby reducing the diameter of the blade ring. In the case of the drive motor which changes its rotational speed as a function of load, a similar diameter reduction occurs when a reduction of the rpm reduces the centrifugal forces which stretch the spokes and expand the blade ring. In the opposite case, when the load decreases, the spokes stretch and increase the blade ring diameter in such fashion that the effect of the aerodynamic forces is less and the effect of the centrifugal force is greater.

In an advantageous embodiment, provision is made for the spokes, fan blades, and connecting elements to be so designed and/or dimensioned that, in the event of load-dependent deformation, essentially constant blade geometry is maintained. This measure ensures that the entry and exit angles of the fan blades likewise change as a function of load, and adjust themselves to the changed load. When the load decreases, the entrance and exit angles increase; they decrease when the load increases.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a partial axial view of a first embodiment of a fanwheel according to the invention, under different load conditions and/or at different rotational speeds;

FIG. 2 is a cross section along line II—II in FIG. 1;

FIG. 3 is a cross section along line III—III in FIG. 1;

DETAILED DESCRIPTION OF THE PREFERRED EMBODIMENTS

Figure 4:
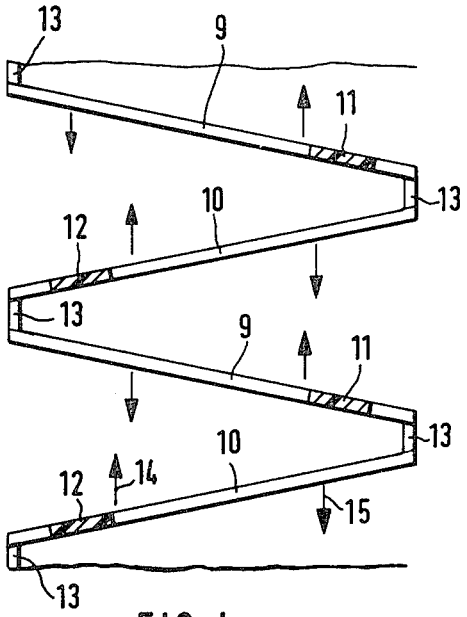
FIG. 4 is a cross section along line IV—IV through the fan blades represented as lying in the plane of the drawing, in the embodiment shown in FIGS. 2 and 3.

In the embodiment according to FIGS. 1 to 4, a hub 1 is provided, said hub being connected by spokes 11 and 12 with a blade ring formed by fan blades 9 and 10. Fan blades 9 and 10 are connected together in such fashion that each of fan blades 9 or 10 is linked at one end with the following fan blades 9 or 10 via a connecting element 13, extending essentially circumferentially. As a result, fan blades 9 and 10 produce a meander-shaped endless structure, running circumferentially around the radial fanwheel. Each fan blade 9 and 10 is linked to the hub by a spoke 11 or 12, respectively. Spokes 11 and 12 are offset relative to each next successive spoke and linked to the hub, symmetrically with respect to a radially extending center plane P extending transverse to the longitudinal axis of the hub and displaced slightly outside the plane P. Plane P also being understood to be a plane of symmetry on either side of which the fanwheel is substantially symmetrical; the symmetry being interrupted by the portion on one side of the plane being mirror image of the other side but circumferentially offset. Spokes 11 and 12 are each tilted slightly axially outward in opposite directions, so successive spokes 11 and 12 form a rough V-shape. The spokes are connected to fan baldes 9 and 10 by smooth, continuous transitions at short distances from the corresponding ends. The endless meander-shaped structure made of fan blades 9 and 10 is thus held in two planes relative to hub 1, said planes being tilted in the rough shape of a V with respect to one another, thus reliably preventing wobbling of this structure, i.e., the blade ring. Spokes 11 and 12 have the form of ribs with flat, rectangular cross sections, so arranged that their narrow sides point in the axial direction in the vicinity of the hub and over most of their length, so that they are warped only for a short distance before the point at which they connect to fan blades 9 and 10. In this way, the air flow to the fan blades is impeded as little as possible.

As FIG. 1 shows, spokes 11 and 12 are bowed in circumferential direction D. This gives the spokes a certain spring action which serves to isolate vibrations which might otherwise be transmitted from the blade ring to the hub. The curvature $\rho$ ($=1/R$) is chosen so that the spokes lead in circumferential direction D, thereby improving the flow to the blades.

Figure 5:
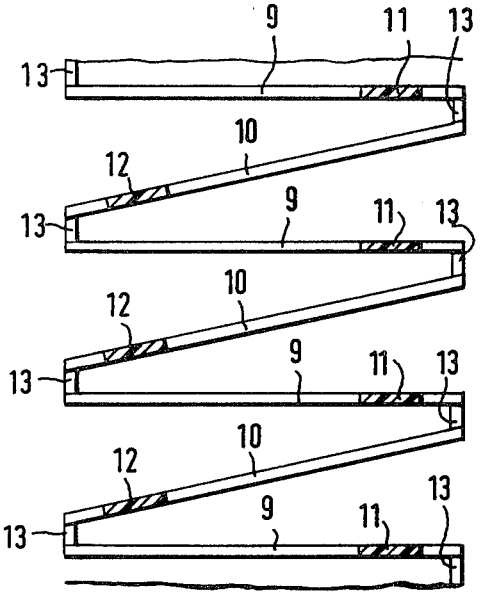
FIG. 5 is a cross section similar to FIG. 4 through another embodiment.

In the embodiment shown in FIGS. 1 to 4, the successive fan blades 9 and 10, viewed in a direction radial to the rotational axis of the fanwheel, are each mounted at a slight angle, in alternate directions, to the rotational axis, as is shown particularly clear in FIG. 4. However, it is also possible to select a different arrangement of fan blades 9 and 10, for example, one corresponding to the embodiment shown in FIG. 5, whereby fan blades 9 and 10 extend alternately at angles to the rotational axis and parallel to the rotational axis of the radial fanwheel. In this way, one side can be used preferentially in a blower of the double-flow type, for example, as far as air intake is concerned.

Figure 6:
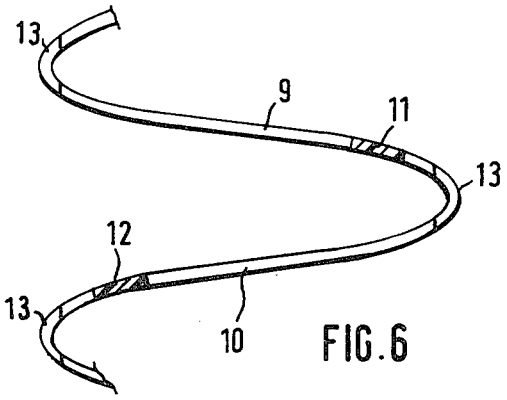
FIG. 6 is a cross section similar to FIG. 4 through a third embodiment of a radial fanwheel according to the invention.

Moreover, it is also possible to provide other shapes for the fan blades; for example, fan blades 9 and 10 shown in FIG. 6 are curved sinusoidally with respect to the rotational axis of the radial fanwheel and are linked together by round conncting elements 13. The diagonal and curved arrangement of the fan blades has the advantage that the noise generated by a radial blower equipped with a radial fanwheel of this type can be reduced, since fan blades 9 and 10 shear the incoming air at a tongue adjoining the outlet opening of a spiral housing, so that no abrupt load occurs which could cause noise to be generated.

Spokes 11 and 12 are curved in opposite directions relative to fan blades 9 and 10, so that fan blades 9 and 10, which are allocated to spokes 11 and 12, respectively, form segments of a sine curve with these spokes. Spokes 11 and 12 are, therefore, twice as long as fan blades 9 and 10. As FIGS. 2 and 3 show, spokes 11 and 12 taper from hub 1 to fan blades 9 and 10 slightly along their axes. In the same way, they can be made to taper additionally in terms of their circumferential extent, i.e., their thickness.

Spokes 11 and 12, fan blades 9 and 10, and connecting elements 13 are manufactured from an elastic plastic material of a relatively small thickness on the order of 0.5-2 mm, so that they can deform elastically even when relatively low forces develop. Depending on the nature of the forces, this deformation primarily takes the form of a change in the curvature ($\rho=1/R$) of spokes 11 and 12 in such fashion that they bow further in circumferential direction D, or stretch counter thereto, whereby the meander-shaped blade ring formed by fan blades 9 and 10 necessarily decreases and increases its diameter, respectively.

Connecting elements 13 are so designed that they extend from the outer ends of fan blades 9 and 10 for only approximately half their height, thus permitting a large diameter for an intake opening to a blower housing. When the diameter increases or decreases, connecting elements 13 preferably are slightly bent or compressed, as shown by arrows 14 or 15 (FIG. 4), about an essentially radial bending axis. Connecting elements 13 then ensure that, when the diameter changes, the blade geometry essentially remains constant, as will be described in greater detail hereinbelow. The connecting elements are then set at a slight angle to their original positions, relative to the radial direction. Compensation of the resultant differences is then produced by a slight twisting of fan blades 9 and 10.

The relatively high elastic deformability of the complete radial fanwheel, with the exception of the hub, results in considerable advantages. First of all, balancing of the fanwheel is eliminated, since any imbalance which may be present results in only an elastic deformation of the radial fanwheel during operation, whereby feedback of vibrations to hub 1 is avoided by the spring action of spokes 11 and 12. In addition, the relatively high deformability ensures that the radial fanwheel adjusts to changing load conditions in conjunction with a load-dependent rotation-changing drive motor, providing feedback to said motor. The radial fanwheel is preferably used in radial blowers for motor-vehicle ventilation, motor-vehicle heating, or motor-vehicle air-conditioning in conjunction with a drive motor which changes its rotational speed as a function of load. Different operation conditions and/or control states of the ventilation, heating, or air-conditioning systems change the mass throughput through the radial fanwheel, for example, as a consequence of changes in the dynamic pressure, valve control, heater or air-conditioner, or even as a function of whether a sunroof or window or the like is opened or closed in a vehicle. As a result of this mass throughput, the aerodynamic forces acting on the individual fan blades change as well, as indicated by the reference mark $P_L$, shown as acting essentially in a circumferential direction, for example, in FIG. 1. In addition to these aerodynamic forces which act opposite to circumferential direction D, the centrifugal forces $P_Z$, which are a function of the rotational speed, act upon fan blades 9 and 10 and spokes 11 and 12. As a result of their deformability, and as a function of the forces, a certain equilibrium is established which determines the shape of the radial fanwheel in each case.

For example, if the aerodynamic forces $P_L$ increase on the basis of the operating state shown at the center of FIG. 1, a modified equilibrium of forces will occur wherein spokes 11 and 12 will have a greater curvature $\rho 1$ $(=1/R_1)$. At the same time, the diameter of the blade ring formed by fan blades 9 and 10 will shrink (FIG. 1, right dashed lines). Since the blade geometry remains essentially constant, the entrance angle $\alpha$ will decrease to a value of $\alpha_1$ and the exit angle $\beta$ will decrease to a value of $\beta_1$. This deformation and the associated adaptation to the changed load is reinforced further when a drive motor, which changes its rotational speed as a function of load, is provided, since an increase in the load reduces the motor rpm so that centrifugal forces $P_Z$ likewise become less, increasing the tendency toward greater curvature of the spokes.

In the opposite case, i.e., when the load drops, the influence of centrifugal forces $P_Z$ predominates, so that the spokes stretch more, i.e., they take on a reduced curvature$\rho 2$ $(=1/R_2)$. Since the blade geometry remains essentially constant, the entrance angle $\alpha_2$ and the exit angle $\beta_2$ (FIG. 2, left) increase. Here again, the effect is further intensified when a drive motor with load-dependent rpm characteristics is used, i.e., a drive motor which increases its rpm when the load decreases.

The range of possible changes in the curvature $\rho(=1/R)$ of spokes 11 and 12, as shown in FIG. 1, increasing or decreasing the diameter of the blade ring formed by fan blades 9 and 10, is 1 to 2 mm. For the sake of ease in illustration, FIG. 1 shows these changes as being more extensive.

The elasticity of the fanwheel has the further advantage that a slight wobble, caused, for example, by manufacture, does not have a negative effect, as might happen, for example, if connecting elements 13 were not absolutely parallel to the rotational axis.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

What is claimed is:

1. In a radial fanwheel of the type having a hub and a plurality of forwardly bowed fan blades which are disposed in an array that is arranged concentrically with respect to the hub forming a blade ring and connected to the hub via a plurality of spokes, the improvement wherein each of the plurality of spokes holds a respective fan blade in the vicinity of one end of the blade and is curved in a direction generally oppositely relative to the respective forwardly bowed fan blade; wherein circumferentially adjacent spokes are arranged relative to a radially extending center plane of the fanwheel and extend radially outwardly from the hub while diverging from said plane; and wherein each fan blade is connected at one end with a fan blade located forwardly of it in a circumferential direction and at an opposite end to a fan blade located rearwardly of it in a circumferential direction by respective connecting elements.

2. A radial fanwheel according to claim 1, wherein the spokes, fan blades and connecting elements are constructed and dimensioned in a manner enabling the radial length of the spokes to change by elastic modification of the curvature of the spokes and the diameter of the blade ring to change by elastic deformation of at least one of the fan blades and connecting elements.

3. A radial fanwheel according to claim 2, wherein the connecting elements are annular segments provided between ends of successive fan blades in the circumferential direction.

4. A radial fanwheel according to claim 1 or 2 or 3, wherein the spokes, fan blades and connecting elements are constructed in a manner enabling an essentially constant blade geometry to be maintained in the event of load-dependent deformation.

5. A radial fanwheel according to claim 1 or 2 or 3, wherein the fan blades, viewed in a radial direction with respect to a rotational axis of the fanwheel, are curved relative to the rotational axis.

6. A radial fanwheel according to claim 5, wherein flat rectangular ribs serve as spokes, the narrow sides of said spokes pointing in the axial direction.

7. A radial fanwheel according to claim 6, wherein the spokes are twisted slightly and make smooth transitions to leading edges of the fan blades.

8. A radial fanwheel according to claim 1 or 2 or 3, wherein the fan blades, viewed in a radial direction with respect to a rotational axis of the fanwheel, are set at angles to the rotational axis.

9. A radial fanwheel according to claim 8, wherein flat rectangular ribs serve as spokes, the narrow sides of said spokes pointing in the axial direction.

10. A radial fanwheel according to claim 1 or 2 or 3, wherein the fan blades, viewed in a radial direction with respect to a rotational axis of the fanwheel, are alternately angled and parallel to the rotational axis.

11. A radial fanwheel according to claim 10, wherein flat rectangular ribs serve as spokes, the narrow sides of said spokes pointing in the axial direction.

12. A radial fanwheel according to claim 1 or 2 or 3, wherein flat rectangular ribs serve as spokes, the narrow sides of said spokes pointing in the axial direction.

* * * * *